US007223941B2

(12) United States Patent
Walker et al.

(10) Patent No.: US 7,223,941 B2
(45) Date of Patent: May 29, 2007

(54) REDUCED-VOLUME COMMERCIAL SPACE HEATING SYSTEM AND METHOD FOR MANUFACTURING SAME

(75) Inventors: David Walker, Cheyenne, WY (US); Gail Sherman, Cheyenne, WY (US)

(73) Assignee: Walker IP and Business Enterprises, LLC, Cheyenne, WY (US)

( * ) Notice: Subject to any disclaimer, the term of this patent is extended or adjusted under 35 U.S.C. 154(b) by 289 days.

(21) Appl. No.: 10/458,013

(22) Filed: Jun. 10, 2003

(65) Prior Publication Data

US 2004/0156158 A1 Aug. 12, 2004

Related U.S. Application Data

(60) Provisional application No. 60/445,514, filed on Feb. 8, 2003.

(51) Int. Cl.
*H05B 1/00* (2006.01)

(52) U.S. Cl. ..... 219/213; 219/528; 219/544; 219/549; 219/217

(58) Field of Classification Search ..... 219/212, 219/213, 492–494, 528, 86.1, 486, 549, 529, 219/544, 217, 202, 505; 29/611; 428/82, 428/349

See application file for complete search history.

(56) References Cited

U.S. PATENT DOCUMENTS 4,245,149 A * 1/1981 Fairlie ..... 219/528
4,661,689 A * 4/1987 Harrison ..... 219/528
4,725,717 A * 2/1988 Harrison ..... 219/528
4,827,103 A * 5/1989 Asp ..... 219/217
4,967,057 A * 10/1990 Bayless et al. ..... 219/213
5,897,802 A * 4/1999 Jones ..... 219/202
5,948,303 A * 9/1999 Larson ..... 219/486
6,294,768 B1 * 9/2001 Liebich ..... 219/528
6,541,744 B2 * 4/2003 Von Arx et al. ..... 219/544
6,770,854 B1 * 8/2004 Keane ..... 219/529
6,958,463 B1 * 10/2005 Kochman et al. ..... 219/544

FOREIGN PATENT DOCUMENTS

FR 09205453 * 5/1992

OTHER PUBLICATIONS

Indus-Tool FW Cozy Foot Warmer by Indus-Tool, Catalog: Home Improvement, as advertised at www.plazahardware.com
Indus-Tool FW Cozy Foot Warmer by Indus-Tool, Catalog: Home Improvement, as advertised at www.amazon.com.
Office Heaters: Cozy Foot Warmer Products, Varioous Advertisements as listed at www.corvallis.com.

* cited by examiner

*Primary Examiner*—Robin Evans
*Assistant Examiner*—L Fastovsky
(74) *Attorney, Agent, or Firm*—Dort Patent, P.C.; David Dort

(57) ABSTRACT

A heating system has been incorporated into the commercial space fixture of a plastic chair mat to provide a space-saving heating system. The material for the plastic mat is chosen based on its thermal and electrical properties to provide necessary safety and support convenience for occupied rolling office chairs. Materials include vinyl, acrylic, and polyethylene. The heating elements are placed into the body of the plastic material, which is connected to conventional electrical elements, such as power source, GFIs, thermostats, and safety shut offs, outside the plastic mat. Other more complicated electronics, such as an anti-static mechanism, may be included as needed by the environment.

34 Claims, 14 Drawing Sheets

REDUCED-VOLUME COMMERCIAL SPACE HEATING SYSTEM AND METHOD FOR MANUFACTURING SAME

CROSS REFERENCE TO RELATED APPLICATIONS

This application claims priority under 35 U.S.C. 119(e) to U.S. Provisional Application 60/445,514 filed Feb. 8, 2003, entitled REDUCED VOLUME COMMERCIAL SPACE HEATING SYSTEM AND METHOD FOR MANUFACTURING SAME, which is hereby incorporated by reference in its entirety for all purposes.

BACKGROUND

The temperature in office and commercial spaces is generally controlled by central systems in discrete locations. Often, workers are unable to get comfortable because they cannot control HVAC system settings. Commercial heating systems are also unpredictable in extreme weather and are often operated minimally during "off-hours." In order to facilitate comfort and productivity, commercial entities may provide or allow workers to provide their own electric or gas space heaters. However, although the cost of such heaters is small, their safety is uncertain, especially when they include electrical heating coils exposed to the air and the body is made of cheap meltable plastic material. More expensive space heaters include ceramic models that provide more safety but still present space and energy efficiency problems in the office. Furthermore, small heaters must be placed in proximity to a worker to provide heat and may represent a fire hazard. Large heaters that may be placed at a safe distance may be noisy, dry the already parched winter air, and take up valuable commercial space. Space heaters are often equipped with blowers in order to direct the heat produced by the elements. One of the solutions for improving the footprint used by space heaters has been addressed by the COZY FOOT WARMER™ and related products sold by many different retailers. These products include a soft rubber mat that includes a heating element running through it that can be plugged into a standard outlet. As such, these devices are useful for providing heat akin to a space heater without taking up vertical space. A variation of the COZY FOOT WARMER™ allows the device to be mounted vertically.

Many workers in commercial spaces currently use chairmats. Such mats provide both safety and convenience for personnel in rolling and/or steno chairs which are generally used to more effectively navigate workspaces. On hard flooring such as cement the mats keep chairs from rolling too quickly and out of control, and also prevent unpleasant noise. On soft flooring these mats allow the worker to move more easily where otherwise the chair wheels get stuck or stalled in carpeting, impeding free motion. The mats also prevent chair wheels from catching on carpets, power cords, files, etc. As such, the mats reduce wear and tear on carpeting or other flooring. These mats are usually made of plastic materials, such as vinyl, acrylic, or other plastics that are flexible and strong. In addition, many of these chairmats have anti-slip mechanisms for the particular environment of their intended use. They may include "spikes" that adhere to carpeting or an alternate type of material if the mat is to placed on another type of surface like concrete, wood, vinyl, etc.

Electrical heating elements have been placed in blankets, chairs, mattresses and other items of furniture for some time.

Placing such heating elements in an office chair or other piece of furniture made of wood, cloth, or a soft plastic is impractical and unsafe, because the presence of heating coils around foam and fabric increases cost and safety concerns that may not be acceptable for workplace standards.

SUMMARY

The present invention combines the commercial space fixture of a plastic chair mat with a heating system in order to provide a safe, personalized, and unobtrusive space-saving heating system for workers in an office or commercial setting. The resulting "reverse electric blanket effect" exploits the most basic of thermal properties, that of heat rising, to the advantage of the worker sitting directly above such as heating system.

The present invention addresses the above-stated problems and creates an economical solution for commercial entities by providing an appropriate plastic rolling mat or chair mat with heating elements integrated into the body of the mat. The plastic mat is a fixture in most commercial spaces, providing necessary safety, comfort and convenience for rolling office chairs while preserving floor surfaces.

The heating elements allow heat to rise directly into the space where the heat is needed, reducing the need for costly HVAC heat and providing much more safety than electric or gas space heaters. The plastic material intended for use in the present invention has thermal properties that make its safety well within workplace standards while still providing heat. Further, the plastic is water-resistant (spills), and generally weather-resistant so it can be used in shop areas that must avoid the presence of heating coils found in conventional space heaters.

In one embodiment of the system, the heating elements are arranged so that heat is generated on the periphery of the mat, providing heat to the worker's space, but not directly below the worker. The shape of the mat is easily configured through multiple conventional plastic manufacturing techniques.

Furthermore, the mat heating system is economical on many levels because it provides reduced energy costs and allows workers to more easily control their own comfort while taking advantage of the already existing configuration of office spaces.

The plastic material intended for use in the mat heating system is chosen for its appropriate electrical and thermal properties, providing the necessary degree of safety appropriate for commercial spaces, including garages where a space heater with exposed coils or flame may not be appropriate. The choice of materials for manufacture and use in the chairmat is also dependent on other end-use considerations such as cost, purpose, and manufacturing technique. In one alternate embodiment newer plastic materials can be chosen for the heating system that do not require electrical elements but provide heat based on the thermal and conductive properties of the mat material because the entire mat acts as a single electrical element. The cost of manufacturing using such materials is may soon become practical for commercial viability. The heating system may include optional anti-slip mechanisms such as "spikes" or rubber bottoms, depending on their intended setting.

The electrical heating and control system of the present invention is made up of components known to those skilled in the art. Particular components, such as thermocouples, thermostats, or GFIs may be added in embodiments that need added features of control and safety, but they also may add to the cost and complexity of manufacturing the system.

DETAILED DESCRIPTION OF THE INVENTION

As can be appreciated by those skilled in the art, the present invention could have several different embodiments, all of which would have various benefits based on the consumer's manufacturing process, end-use requirements, pricing, and safety criteria.

Figure 1:
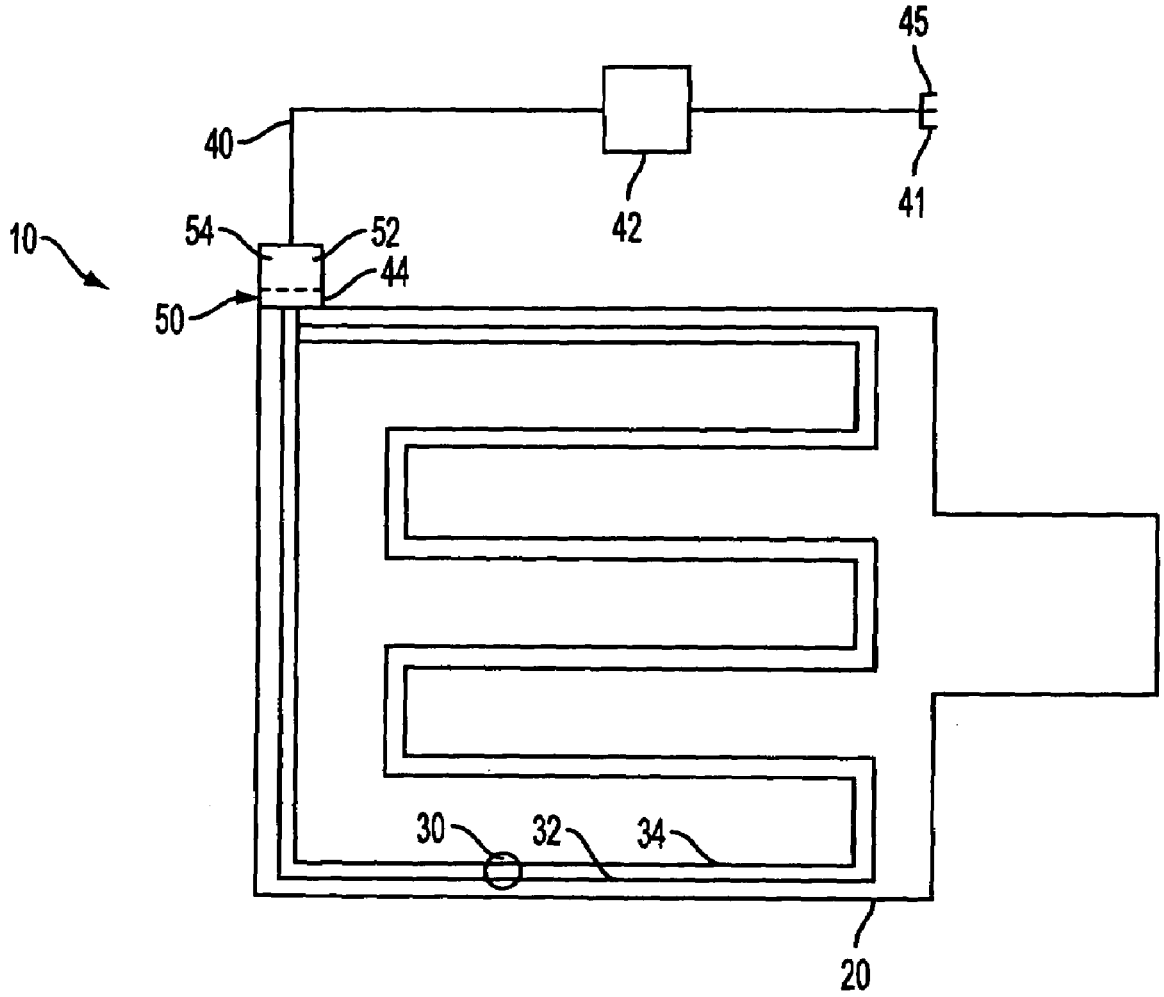
FIG. 1 depicts an embodiment of the reduced-volume heating system.

Referring now to FIG. 1, a preferred embodiment of the invention is shown. A heating system 10 includes a sheet or mat of appropriate plastic material 20 in a desired thickness for use as a rolling chair mat in a commercial space. Enclosed in the plastic material 20 is a single electrical heating element 30 that includes a heating coil or wire 32 and optional insulating material in the form a sleeve or air (or gas) pocket 34. The heating system 10 includes an electrical supply system 40, which includes an electrical plug or other standard power connection 41. The electrical supply system 40 may be connected directly to the heating element 30 or connected to the heating element 30 through a transformer or converter 42 and/or a safety interface 44. In some embodiments, the electrical plug 41 will include a ground prong 45, but in alternate embodiments grounding may be provided in other ways.

Figure 16:
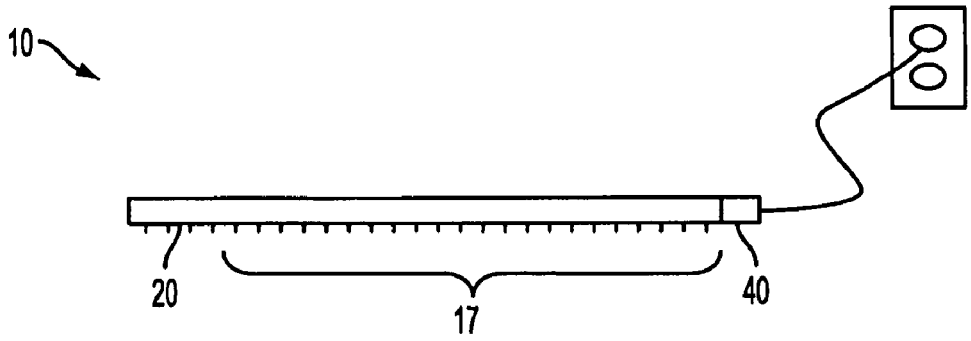
FIG. 16 illustrates the heating system with an optional anti slip device in the form of spikes.
Figure 17:
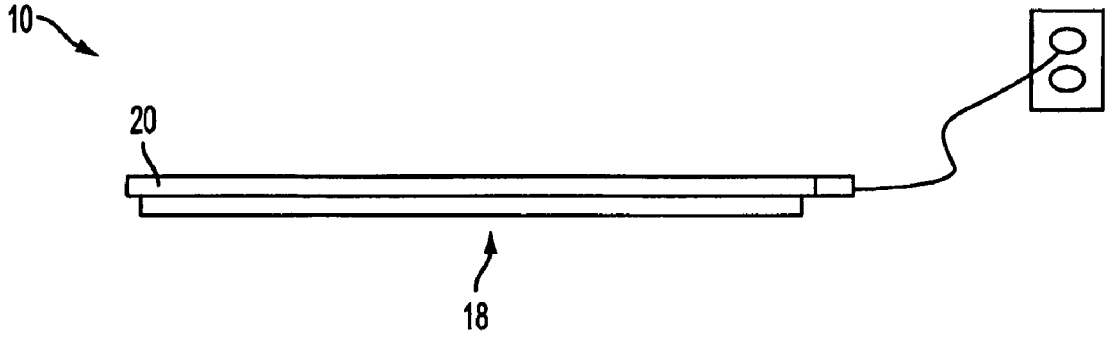
FIG. 17 illustrates the heating system with an optional anti slip layer.

FIG. 1 also depicts optional heat controls 50 that may be connected in-between the plug 41 and the transformer/converter 42 or between the transformer 42 and the heating element 30. As can be appreciated by those skilled in the art, the heat control 50 may be included in particular embodiments, but it may increase the complexity and price of the system. The control 50 includes an optional thermostat 52 and an optional emergency shut-off 54. FIG. 16 shows the optional feature of the present heating system 10 with a "spiked" bottom 17 that may prevent slippage on certain types of carpeting by penetrating the surface of the carpet. As can be appreciated by those skilled in the art, the manufacture of a vinyl (or alternate material) sheet with the heating elements is not made significantly more complicated by the inclusion of a "spiked" or "cleated" bottom. FIG. 17 depicts a second alternate optional anti slippage feature in which the bottom of the heating system 10 has a rubber anti slip layer 18. The anti-slip layer 18 may also be made of other types of material, such as alternate types of plastic that would be appropriate for an intended surface of use. Thus, the anti slip material 18 may be seen as similar to using different types of casters on a rolling chair to accommodate a floor surface.

Figure 2:
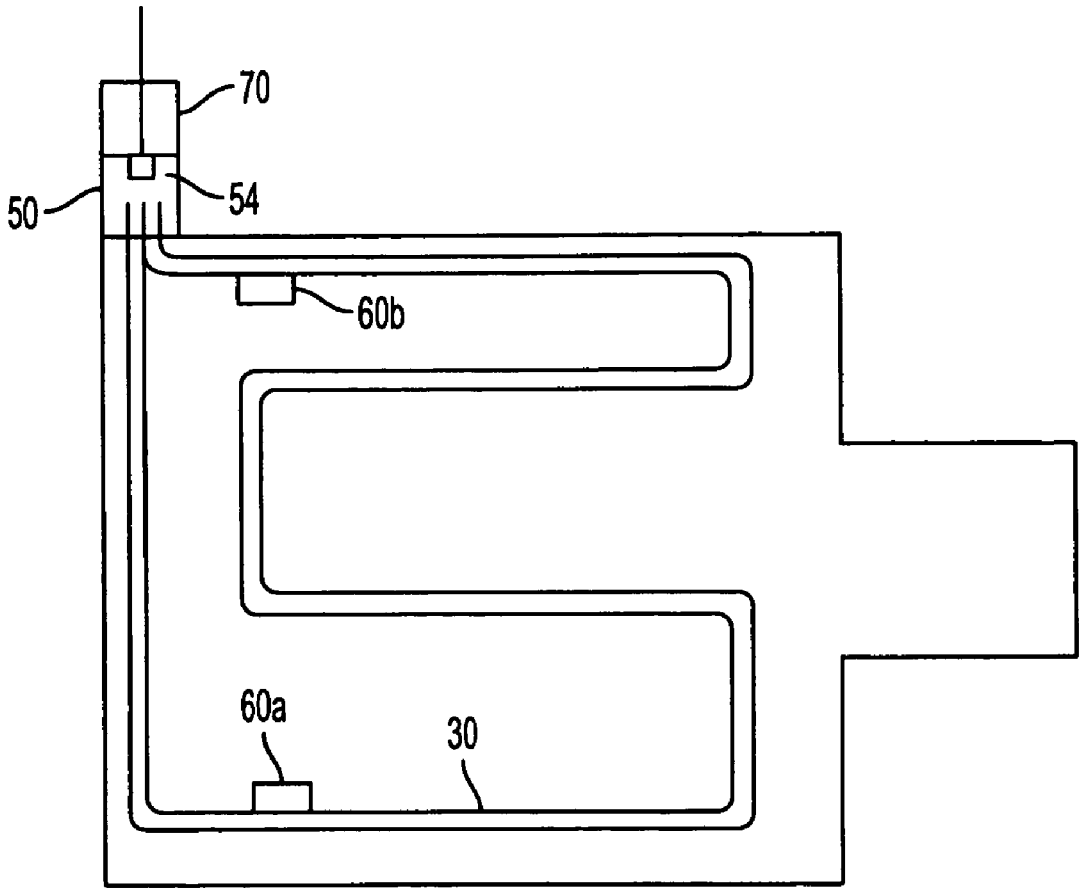
FIG. 2 shows an alternate embodiment of the invention.

FIG. 2. depicts an alternate embodiment of the invention in which one or more thermocouples 60*a*, 60*b*, . . . are included in the body of the plastic material 20. The one or more thermocouples 60*a*, 60*b*, . . . , can monitor the temperature of the plastic material 20 at critical junctures 62, where the electricity to the heating elements 30 can be shut off by the emergency shut off 54 in the control 50 or by an optional regulator 70 in case the plastic material gets too hot.

Figure 3:
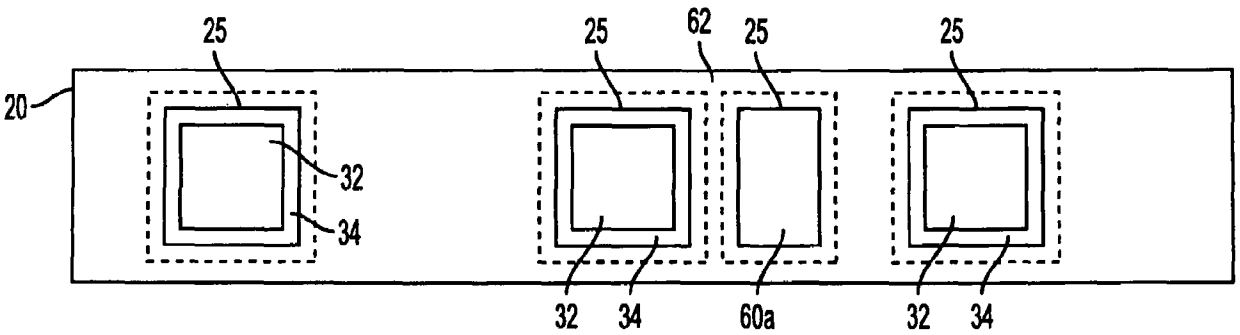
FIG. 3 is a cross-section of an embodiment of the invention and is representative of a manufacturing process for the invention.

Referring now to FIG. 3, a cross-section of the heating system 10 is shown. In this embodiment, one possible manufacturing process for the system can be more easily understood. As can be appreciated by those skilled in the art of plastics manufacturing, the heating system 10 can be implemented by placing the heating element 30 (and other components) into the single piece of plastic material 20. The body of the plastic material 20 includes a hypothetical space or bond 25 that is either created by the volume heating coil 32 and the insulating material 34 or by the adhesion in the plastic material 20 to the element 30. One example of a manufacturing process of this embodiment is the well-known process of plastic mold injection manufacturing, in which the precursor (melted) of the plastic material 20 is shot into a mold that includes the electrical heating elements 30 and other components intended for inside the plastic mat 20 which are already properly placed in the mold. This is illustrated by FIG. 9, but is not necessary for understanding the invention because it may be manufactured in other ways.

Figure 4:
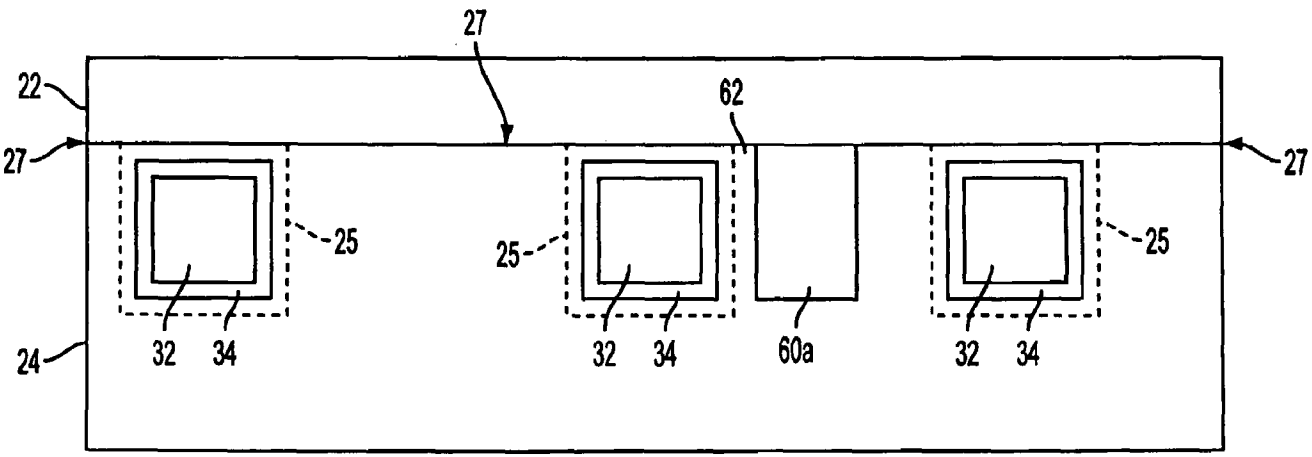
FIG. 4 is a diagram of a cross-section of an alternate embodiment of the invention and is representative of a different manufacturing process.

Referring now to FIG. 4, a cross-section of an alternate embodiment of the heating system 10 is shown. In this case, the plastic material 20 includes two (or more) sections, A 22 and B 24. Either section A 22 or section B 24 can be molded, stamped, shaped, or otherwise manufactured to appropriately accommodate the heating element 30 and other components (60*a*, 60*b*) at an open end. In this example, section B 24 is manufactured such that at the top, the heating elements 30 can be easily placed into the hollowed plastic areas or bonds 25*a*, 25*b*, . . . . The heating elements 30 and other components 60*a* are placed into the top of section B 24 after it is prepared. Section B 24 is then assembled, glued, heat-welded, chemically welded, or otherwise appropriately attached to section A 22 at the boundary 27. Thus, this embodiment may have some manufacturing advantages over the embodiment depicted in FIG. 3 because the heating elements 30 are not necessarily subjected to, nor must they withstand, the conditions of a plastics manufacturing process.

The range in choices of materials suitable for the manufacture of the plastic mat 20 in the claimed invention can be appreciated by those skilled in the art of plastics manufacturing. References that include discussion of the suitability of particular plastic materials for certain purposes in the present invention include polymer and plastic science textbooks such as the *Textbook of Polymer Science*, 3$^{rd}$ *ed* by Fred Billmeyer Jr., John-Wiley & Sons, and appropriate industrial literature, such as that available from the Society of Manufacturing Engineers on manufacturing, *Working with Vinyl, Working with Polyethyelene, Working with Acrylic*, and *Working with Polystyrene*, etc. Bill Fry, 1999. The relevant portions of these references, as they are needed to practice the invention, are herein incorporated by reference for such purposes.

In considering the manufacture and operation of the present invention, the following properties of the plastic material 20 chosen for the mat should be considered:

The melting temperature should be in excess of the junction temperature where the heating element 32 or insulation of the wire 34 is in contact with the plastic material 20, and should not be greater than a threshold temperature, which is 85 degrees F. in one embodiment. The melting temperature should be at least twice that contact temperature. Thermal resistivity is another property that should be considered in the choice of material.

The thermal conductivity (of which one formula for calculating is: [10−4(10 to −4th power) cal-cm/(s-cm2 (squared)×Degrees C.))] of the plastic mat 20 should be relatively high for plastics. As can be appreciated by those skilled in the art, without a reasonable high thermal conductivity, the plastic mat 20 could potentially become soft at the point of the heating wire element 30 and not radiate to either side, creating warm areas only along the heating element 30.

The tensile strength, compressive strength [lb/(in. 2 (inch squared)], and flexural strength [lb/(in. 2 (inch squared)] must be appropriately chosen in order to support a chair caster or chair foot with a person (up to at least 100 kg) in the chair. The plastic material 20 should be chosen not to break under such conditions because that would potentially interrupt the continuity of the heating element 30. A crack would allow foreign matter to enter and compromise the electric element 30 and element-to-plastic bond 25 or plastic-to-plastic boundary 27.

The coefficient of linear expansion [10**6 (10 to sixth power)in./(inch*degrees C.)] for both the plastic 20 and the heating element 30 should be consistent with each other such that the heater/chairmat 10 would not expand when heated tearing or displacing the heating coil 32. Likewise, the heating element coil 32 should not expand/contract within the mat 20 to causing itself to break or to disturb the material/element bond 25.

The dielectric strength (V/mil) of the plastic material 20 must effectively electrically insulate the mat from the heating element 30 so the elements are not electrically shorted to each other.

Two additional properties that should be considered are that the mat cannot get warm enough to melt or cause chair casters to soften or score the mat, and any dirt or rocks on the mat cannot become embedded in the mat material, easy cleaning is necessary. Furthermore, the chairmat must be reasonably flexible to the extent the above properties can be incorporated. A more flexible mat would be preferable.

Figure 5:
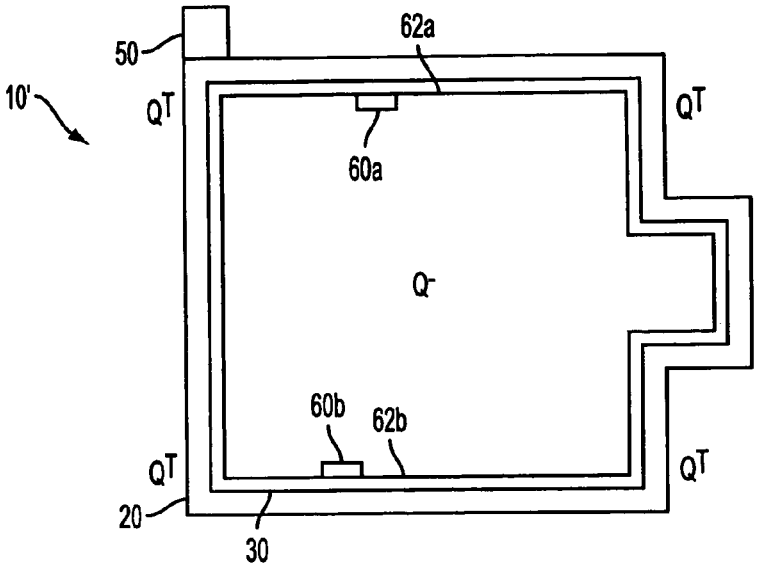
FIG. 5 depicts an alternate arrangement of the heating element.

FIG. 5 shows an alternate arrangement of heating elements 30 in the plastic material 20. In this alternate embodiment, the heating coils 32 are placed in an alternate arrangement, such as the periphery of the mat, so that the heat does not directly rise to the worker. Also, in this configuration, the heating coils 32 do not lie in the area of the plastic material 20 that most under the pressure of chair wheels, which would generally be at the center. This area is defined for purposes of the invention as a high stress area on the surface of the mat.

Figure 6:
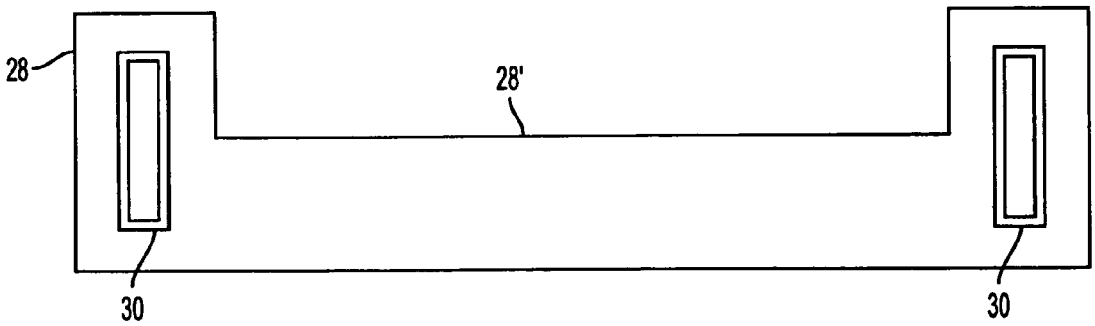
FIG. 6 depicts an alternate embodiment of the invention with additional protection and insulation of the heating elements.

FIG. 6 depicts another embodiment of the invention in which an alternate arrangement of plastic material 20 is configured such that it has one or more protective covers in the areas in the locations 28*a*, 28*b*, . . . , where the heating element 30 is present. Thus it may be possible to reduce the compression, risk of breakage, etc. on the plastic material 20 at the location of the heating element 30. FIG. 6 shows an increase in the depth of the plastic material 20 where the element 30 is present, but other protective devices, such as material substitution, may be employed resulting in a similar effect.

Figure 7:
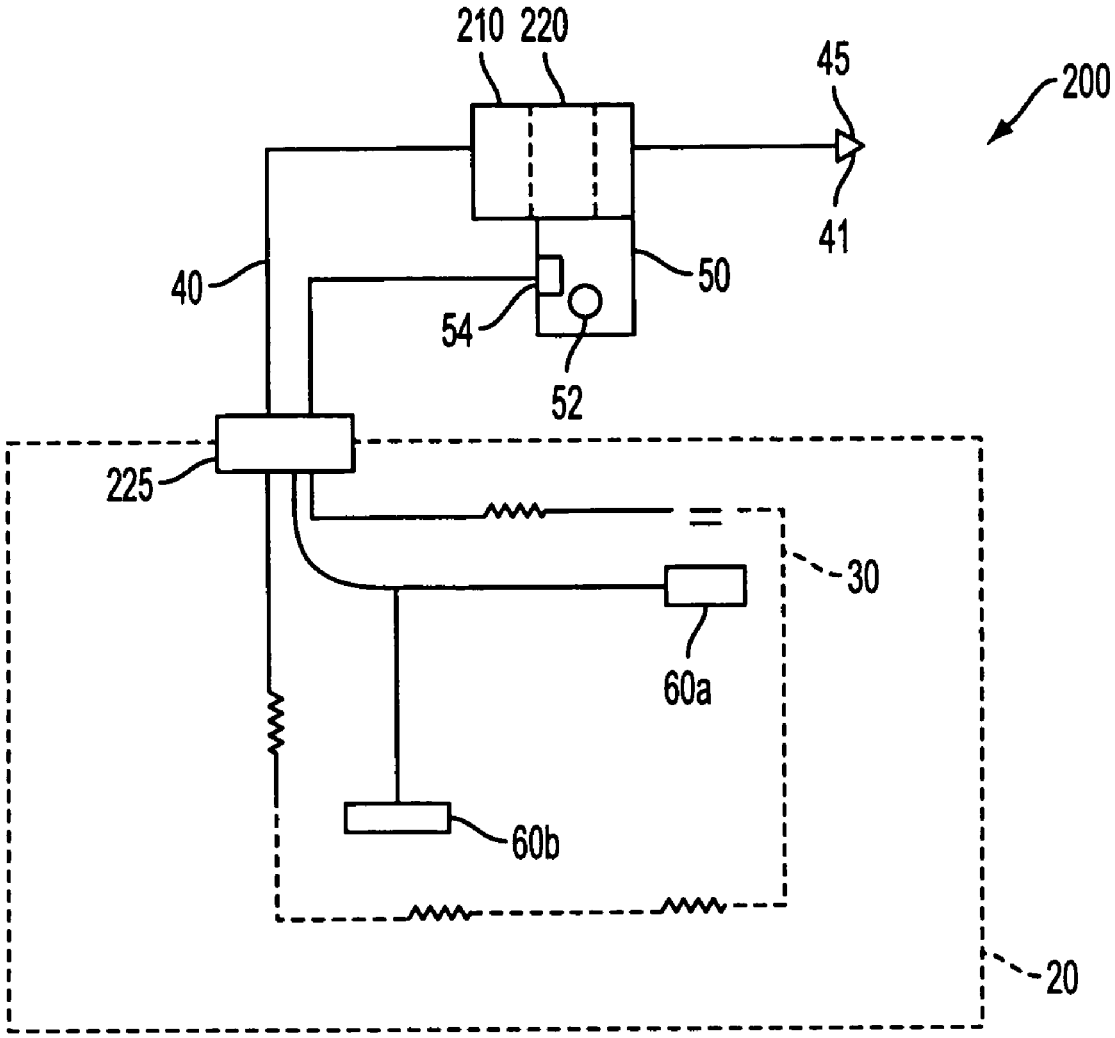
FIG. 7 is a block diagram of the electrical components of the present invention.

FIG. 7 shows a block electrical diagram of an embodiment of the electrical system 200 of the heating system 10 of the present invention. Those skilled in the art will be aware that the electrical system 200 could have different implementations that do not depart from the invention, but may be based on particular needs or criteria of the apparatus embodying the invention. The criteria could include safety features, optional control features, manufacturing costs, intended end-use, etc. The electrical elements of the system 200 include at least a power supply system 40, a heating element 30, and an interface 225. Optionally, one or more thermocouples 60*a*, 60*b*, . . . are monitored by a heat control unit 50 that usually includes a thermostat 52 and may also optionally trip an emergency shutoff 54 that shuts down the electrical flow if a critical temperature is reached. Individual components of the electrical system would also be chosen based on the requirements mentioned above. In a preferred embodiment, the heating element 30 includes a nichrome wire.

The power may be controlled or regulated by a converter 210 in which standard AC current input through the electrical plug 41 is converted to 12 V DC or other appropriately limited voltage (and/or current). Optionally, a Ground Fault Circuit Interrupter (GFI) 220 may be included as a separate device or incorporated structurally into the converter 210. As such, the GFI substantially improves the safety of the device, even if it already includes the standard ground prong 45 in the electrical plug 41. As can be appreciated, other grounding devices may also be appropriate.

In one embodiment of the invention, the heating element 30 is similar in structure and character to that used in the defrosting of car windows. The electrical properties of the element 30 should allow adequate heat to be produced but also limit the current (in addition to any converter 210) and plastic material 20 temperature. The point at which the electrical power connection to the mat occurs is the interface 225 and can include a rubberized plug connection 225 that adds to the safety of the mat but does not add substantially to the cost. Depending on the properties of the material, the spacing and size of the heating elements chosen for the present invention can vary. Furthermore, the thermal and electrical properties of the plastic material 20 will determine whether an appropriate insulating material 34 must be present to insulate the heating element 30 from the plastic material 20 and which such material 34 would be appropriate. Such materials range from vinyl to polyethelene, and may include rubber as well, but would be easily referenced by a handbook on insulating materials known to those skilled in the art.

The heating system 10 of the present invention can be adapted for a variety of different geometries, depending on the space in which they are used, including L, T, rectangular, and cross-shaped (and combinations thereof). The manufacturing of the heating system 10 may be adapted to accommodate different shapes of plastic mats, including customized shapes as are needed in the marketplace.

Figure 8:
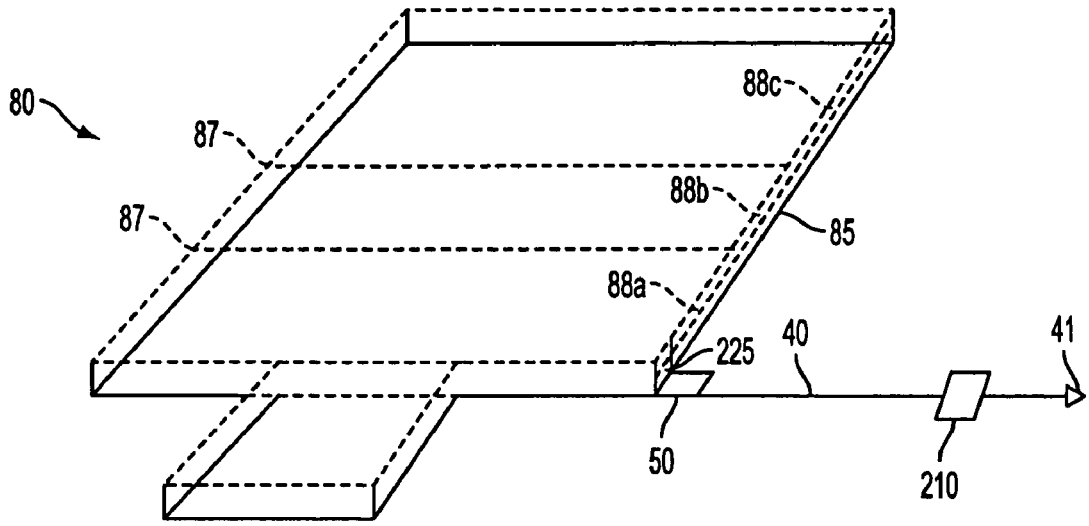
FIG. 8 shows an alternate embodiment of the present invention, that uses a conductive composite material in the mat as the heating element.

FIG. 8 depicts another embodiment of the heating system 80 in which the heating element is the plastic material itself 85 or layered in-between other layers of plastic material 87. The properties of such material 85 are varied but may include carbon-fiber materials, including resins and carbon-aluminum resins capable of the proper amount of resistance to produce heat. However, other materials may be appropriate, provided that they produce the desired flexibility of the chairmat 10 (too rigid a material would not be appropriate). Some of the electrical, thermal flexural and strength properties of these materials are known by those skilled art and are included in the text *Modern Plastics Handbook*, Charles Harper, Ed. (McGraw-Hill, 2000), which is hereby incorporated by reference for understand how to implement such material into a particular embodiment of the invention. There may be more than one electrical contact 88*a*, 88*b*, . . . needed to provide the proper power supply to such a material 85 or a continuous or discontinuous insulated electrical band. In another embodiment of the fiber and/or resin based single heating element, there is a layer of such material in between a more traditional non-conductive material like clear vinyl.

Figure 10:
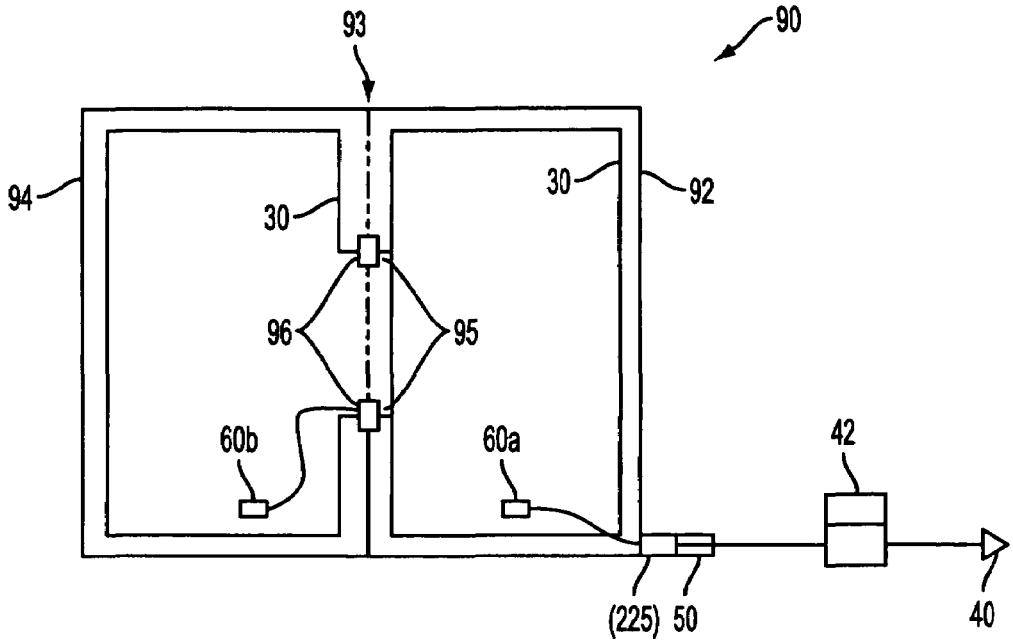
FIG. 10 depicts an alternate embodiment of the invention that folds.

Other embodiments would include a folding plastic heater chair mat 90 embodiment, depicted in FIG. 10, in which a pair of plastic panels 92 and 94, each with a heating element 30, are connected by a pair (or more if needed) of (preferably flush) hinges 95 that both act as a conductor and cover the electrical heating element. The addition of mechanical features would add to the cost and reduce the simplicity of the preferred embodiment.

The chairmat of the present invention may include electronic sensors or devices that may be appropriate for an industrial or commercial setting, including automatic shutoff and anti static functions thereby consolidating necessary electronics for the economical operation of the heating system and other types of devices. Other relevant features may be included that are appropriate to the particular environment in which the chairmat will be used. Because the chairmat must include at least a few electrical components to operate the heating elements, other types of elements that detect or affect safety and/or economy can be included in the present invention.

Figure 11:
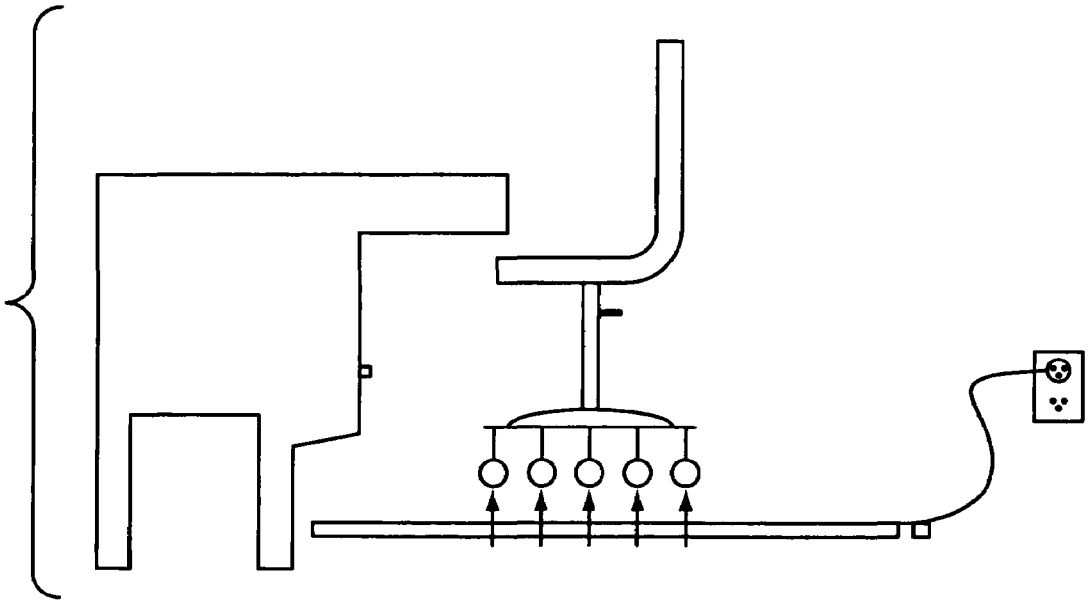
FIG. 11 shows an embodiment of the invention with a pressure sensor.

Referring now to FIG. 11, a set of pressure detectors 315 may be included in a strategic part of the heating system sheet for various safety and efficiency purposes.

Figure 12:
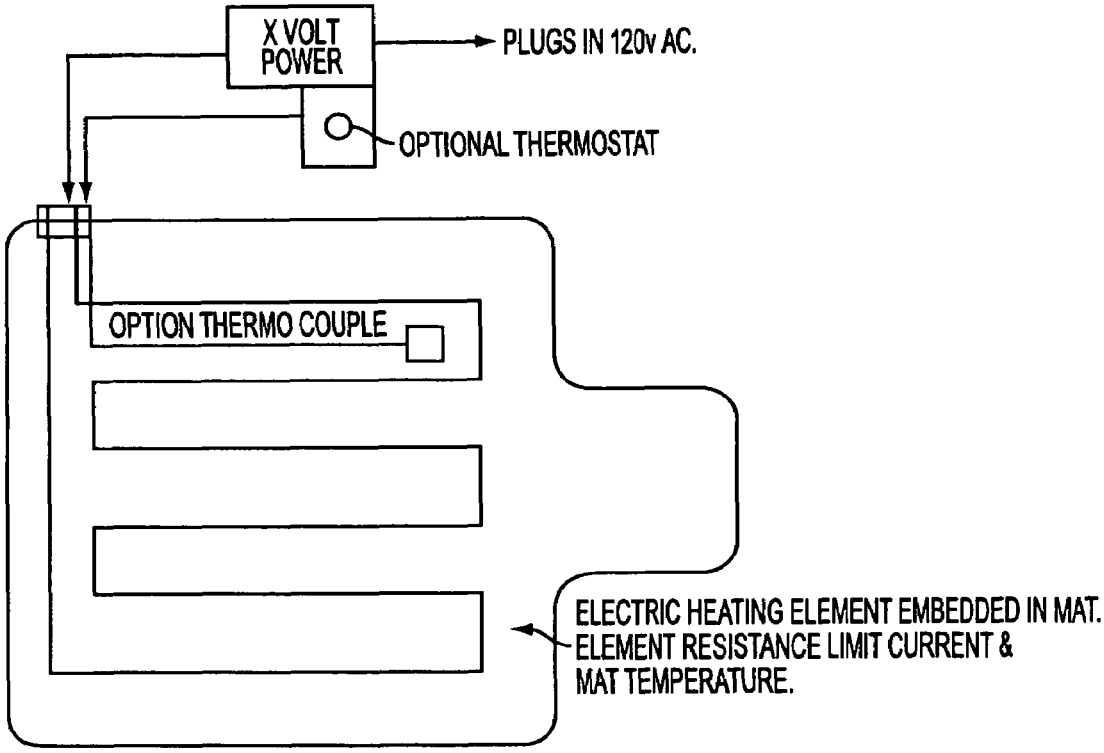
FIG. 12 shows an embodiment of the invention with a presence detection system.

Referring now to FIG. 12, an embodiment with a sensor for controlling the operation of the heating system based on a user's attendance is shown. The heating system includes a sensor system 300 that is electrically connected to the power supply 40 through an external interface or connection 305. The attendance sensor system 300 may include a pressure sensor 315 on the chair and a timer (not shown) to shut off the heating system when a user is not present. Alternately, there may be a connection 350 to a personal workstation or a static field detector that determines the presence of a user by an alternate method. The attendance sensor system 300 can be connected to the workstation, but is connected to the controller 50 and/or power supply 40 through an internal or external connection 320. For the sake of efficient manufacturing and implementation, it is contemplated that all the electrical/electronic components of the present invention will be located as near to each other as possible, but as one skilled in art can appreciate, there are desirable alternate configurations.

Figure 13A:
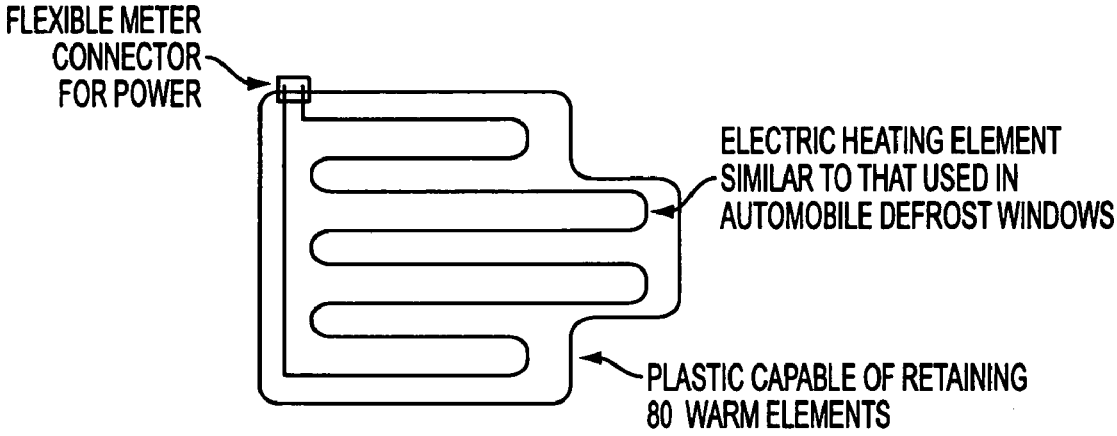
FIG. 13 shows the heating system including an environmental conditions detection system.
Figure 13B:
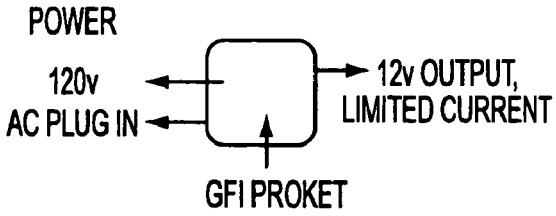
Figure 13C:
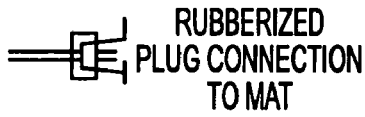

FIG. 13 shows another optional feature of the present invention, in which a device for detecting an environmental condition 395 is also included. The environmental detection device 395 may be incorporated into the material 20 and may include a chemical, radiological, biological or other type of detector. Depending on the type of detector 395, an opening to the environment 396 may also be included. A connection 398 to an indicator is also an optional feature in another embodiment. Thus, the heating system with such a feature may be designed for use in particular industrial or commercial environments where detection of harmful conditions is necessary.

Figure 14:
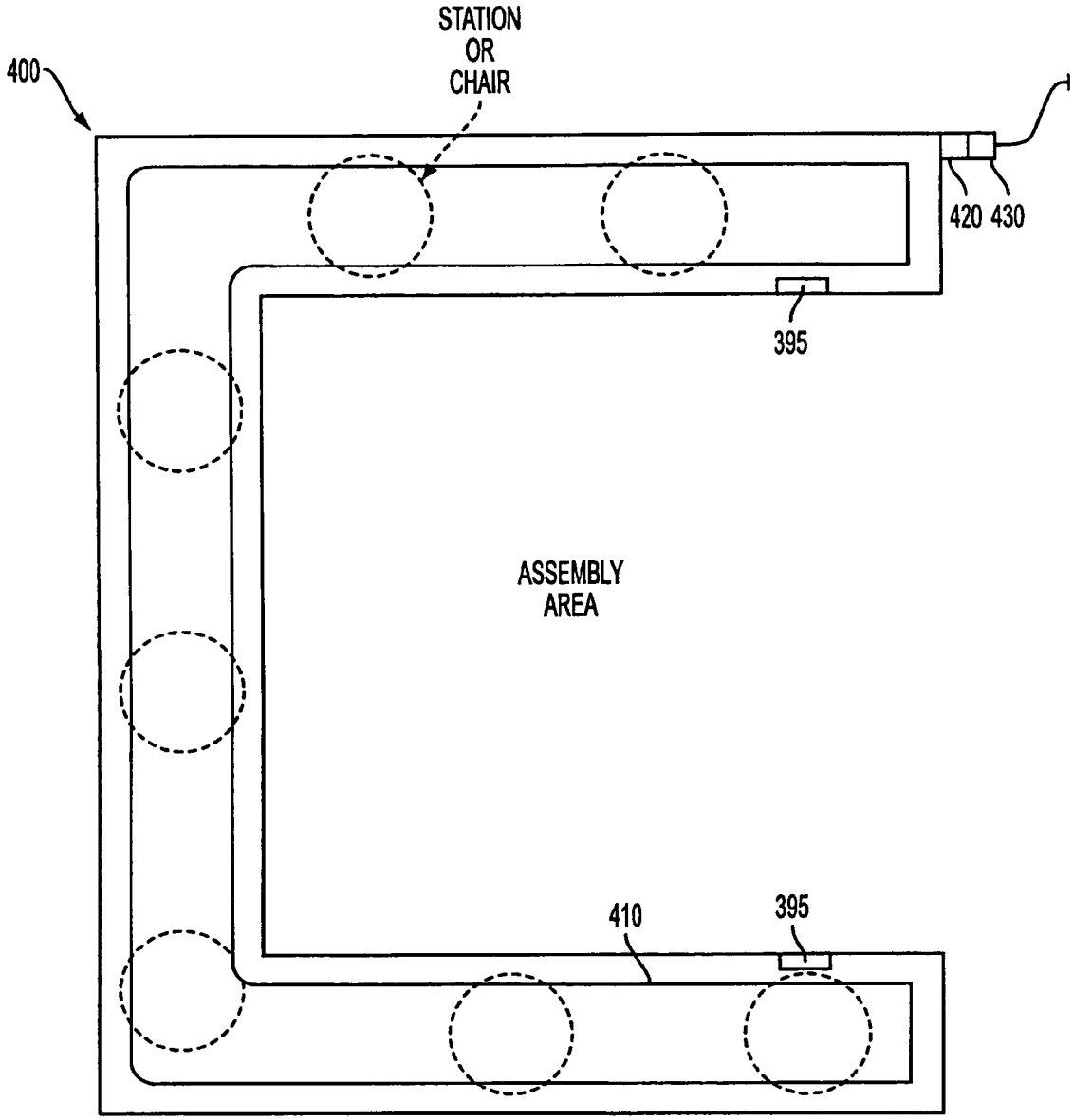
FIG. 14 shows an embodiment of the heating for multiple users.

Referring now to FIG. 14, another alternate embodiment in which the heating system 400 is used for an alternate space arrangement of an industrial workspace for multiple workers (the diagram shows an assembly table for seven seated workers) is shown. The arrangement of the components of the invention in the single office chair is adapted for an industrial space but has the same set of components, including a power supply system 430, optional control 420, and a heating element 410. Such a device may be particularly useful in settings where the atmosphere in the industrial space is hard to control or must be kept below a comfortable temperature. Although the invention contemplates a chairmat, similar materials would be appropriate for standing worker as long as the chairmat met appropriate industrial needs. The above-mentioned optional environmental detector may be added as appropriate for the setting.

Figure 15A:
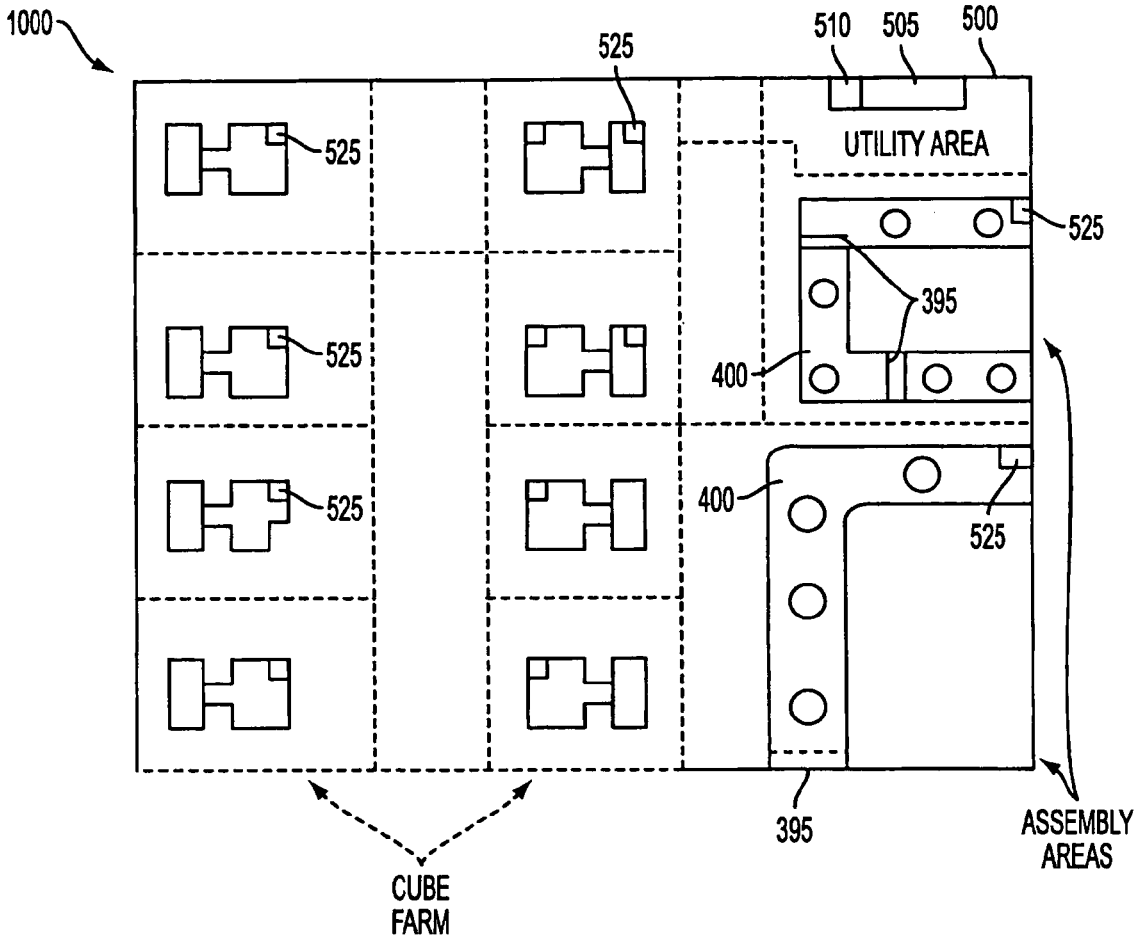
FIG. 15 shows a combination industrial/commercial setting using the present invention in a wireless environmental feedback system.
Figure 15B:
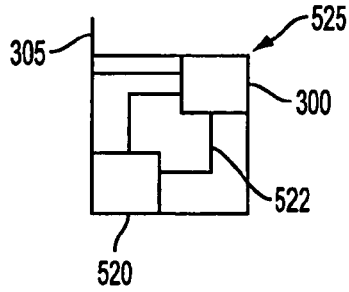

FIG. 15 represents a possible embodiment of the present invention in an industrial/commercial setting with both individual heater chairmats 10 in the "cube farm" and larger versions of the heating system 400 that were shown in FIG. 14 in the industrial or assembly areas. The individual heating systems may be controlled by a central environmental control program running on a computing device 500 through a simple wireless receiver/controller 525 on the individual heating systems 10 or 400. The computer device detects and broadcasts appropriate information to each device through a wireless broadcaster 510, such as an IEEE 802.11 or a similar system. As such, the computing device can track the temperature conditions in individual space, allowing an entity not only to make workers more comfortable but determining where money may be saved by reducing wasteful or irregular energy consumption. FIG. 15B illustrates an individual temperature controller 525 on the individual heating systems 10, which includes the presence detector 300 and a processor 520 that is connected by a bus 522 and has an optional external interface 305.

Figure 18A:
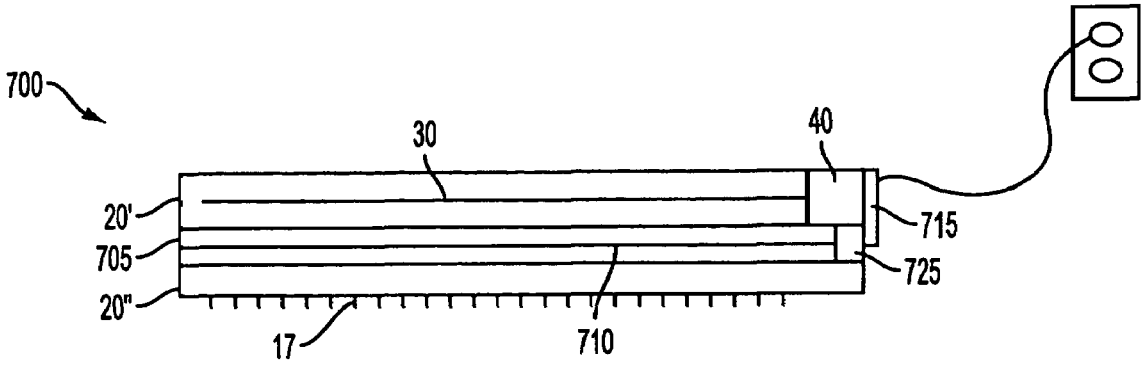
FIG. 18A shows the heating system in an embodiment with an anti static system
Figure 18B:
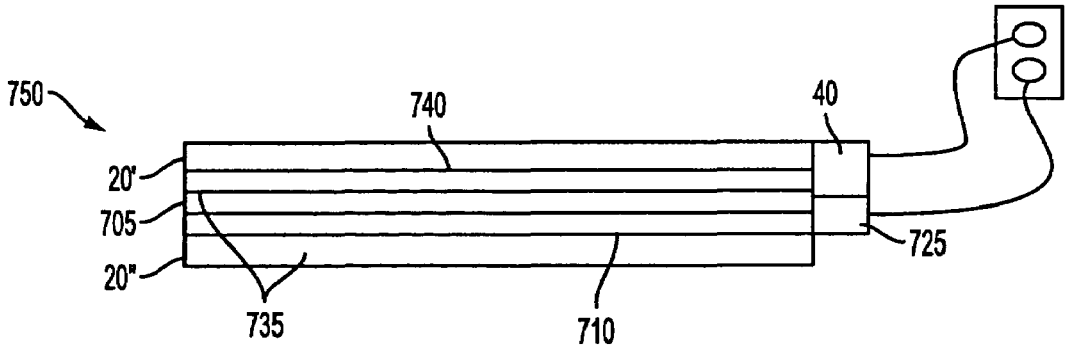
FIG. 18B illustrates an alternate embodiment with an anti static system and an insulating layer.

FIGS. 18A and 18B show further embodiments of the invention that include the anti static functionality and feature for the office or industrial workspace that take advantage of the fact that an electrical system is already present in the heating system. The inclusion of the anti static function would be appropriate in industrial and commercial workspaces where this feature is needed, such as where electrically sensitive components could be harmed by static electricity. FIG. 18A shows a heating system with integrated anti-static function 700. The vinyl layers 20' and 20" are the "dissipative" layers, but top layer 20' still includes the heating element 30 in order to provide heat for the user. An anti static conductive layer 705 includes a conductive element 710 and an electrical transition device 725. An integrator/splitter 715 may allow the anti static electrical element to be plugged into the same socket as the power source 40 for the heating elements 30. However, the integrator/splitter is optional. FIG. 18B shows an alternate anti static version of the heating system 750 that has a dissipative layer 735, and/or an optional electrically insulating layer 740 below the layer 20' that includes the heating elements 30. In other industrial environments conductive mats may be appropriate as well.

Figure 9A:
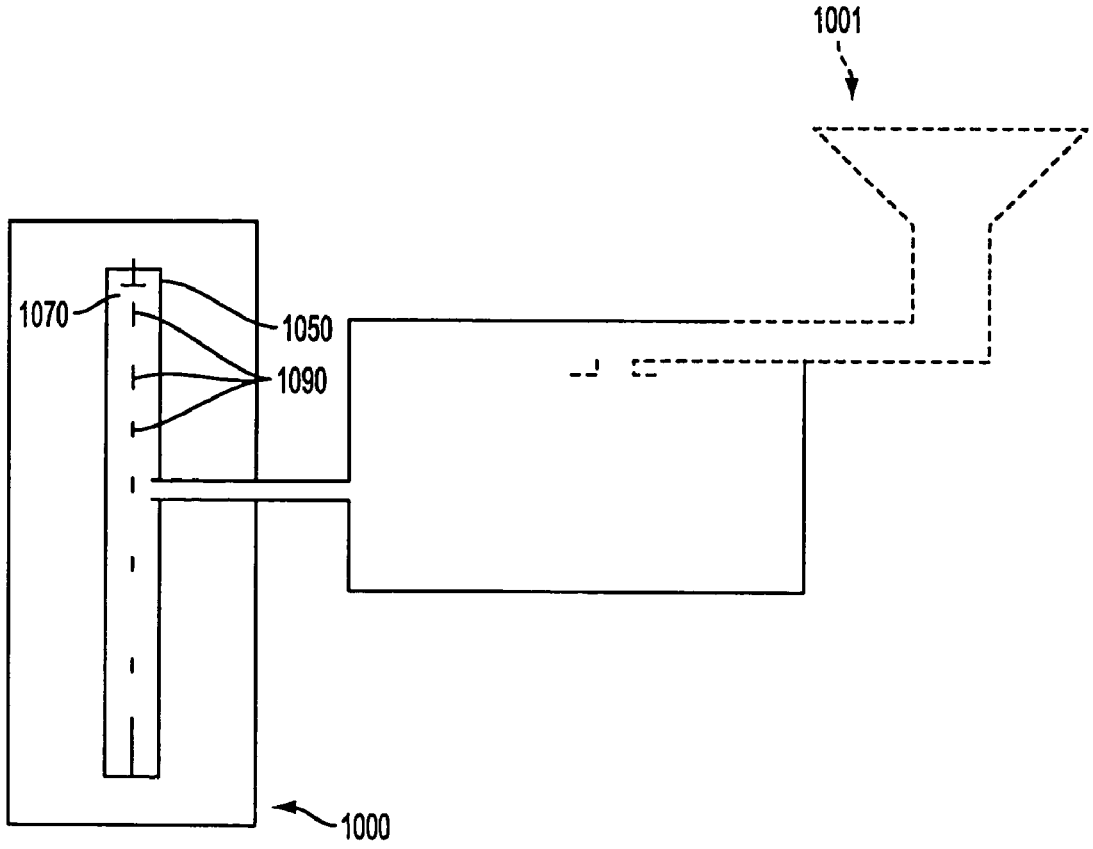
FIG. 9A depicts an example of FIG. 3; a sample injection mold manufacturing process for the heating system.
Figure 9B:
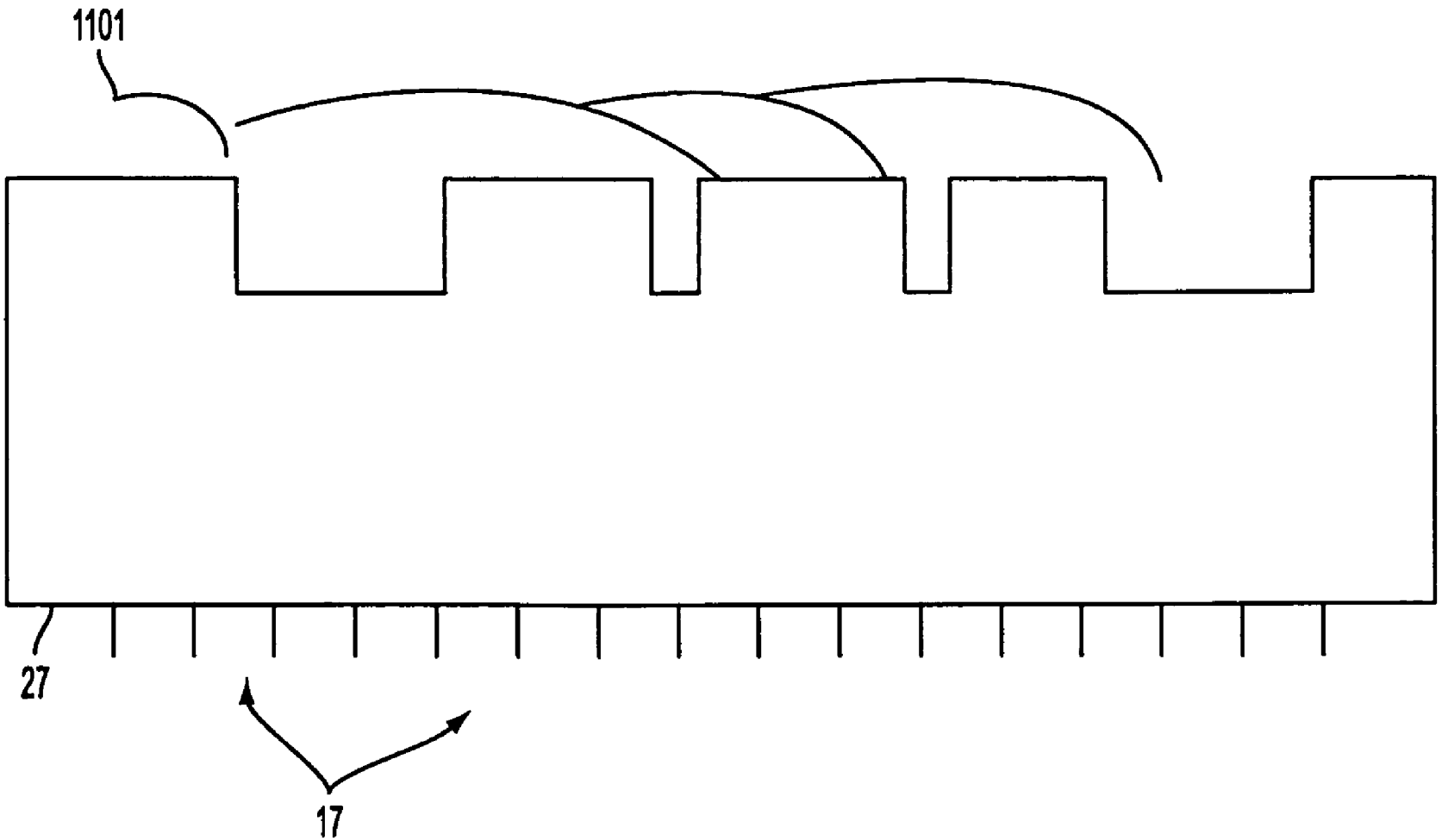
FIG. 9B depicts an example of FIG. 4; in which the sheet is manufactured in two separate parts.

Referring now to FIG. 9A, a sample of a manufacturing method for the heating system is shown. A plastic mold injection system 1001, as known by those skilled in the art, includes a mold 1000, that includes a die 1050 of the desired dimensions for the floormat. Electrical elements, such as heating element 30 and optional sensors 60*a*, 60*b*, . . . are placed in a desired arrangement 1070 with material appropriate for the process, possibly including the material used in the sheet. Optionally, a protective coating 1090 for the electrical elements 30, 60*a*, . . . may act as the insulating sleeve 32 as well. In another embodiment represented by FIG. 9B, the electrical elements are placed into a plastic sheet with a series of pre-configured cut-outs 1101 at one end, that represent the top or bottom half (the bottom half is shown) 24 of the sheet 20. This allows for easier placement of the electrical elements, but requires the additional step of adding a top layer 22 as described above. Thus, the layer 24 may be manufactured by multiple methods, but it is more easily made by plastic mold injection than the single layer detailed above.

The examples provided in the description of the invention are meant to be illustrative and not limiting. Other uses for the heating system are possible without departing from the spirit and scope of the invention. Furthermore, the heating system 10 may also be appropriate for rugged outdoor use where gas or electric space heaters are either inappropriate or ineffective and the rugged plastic material 20 used in the invention is more suitable.

We claim:

1. A chairmat appropriate for industrial, commercial, or office use including: a single sheet made of a material sufficient for stably supporting an occupied rolling chair; at least one heating element enclosed inside the body of said single sheet of material, with a connection of said at least one heating element exposed outside of said sheet, a power source, including an AC plug, a ground, and a power control device electrically connected to said exposed connection; wherein said single sheet of material can absorb heat dissipation from said at least one heating element enclosed therein and maintain stability;

further including an automatic shut off device connected to said power supply and capable of removing power from said at least one heating element and wherein said at least one heating element is configured such that it is not located in a high stress area on the surface of said single sheet of material.

2. The chairmat recited in claim 1, wherein said single sheet of material includes vinyl.

3. The chairmat recited in claim 1, wherein said single sheet of material includes acrylic or polyethylene or combinations thereof.

4. The chairmat as recited in claim 1, further including an anti-slip mechanism, said anti-slip mechanism on the bottom of said chairmat and part of said single sheet, wherein said anti-slip mechanism comprises projections.

5. The chairmat as recited in claim 1, wherein said single sheet of material has a thermal conductivity, such that it does not become soft at the point of contact with said at least one heating element.

6. The chairmat as recited in claim 5, wherein said single sheet of material is manufactured such that it has a tensile strength such that it can support a chair occupied with up to 135 kg.

7. The chairmat as recited in claim 1, wherein the configuration of said at least one heating element is continuous around the inside edge at a target distance from the edge of the chairmat and not in the center portions.

8. The chairmat as recited in claim 1, further including a thermostat, said thermostat include at least one sensor.

9. The chairmat as recited in claim 8, wherein said at least one sensor is located in said sheet.

10. The chairmat as recited in claim 8, further including an automatic shutoff device connected to said thermostat and said at least one sensor.

11. The chairmat as recited in claim 1, further including a sleeve structure to protect said single sheet of material from said at least one heating element, said sleeve located in between said at least one heating element and said single sheet of material.

12. The chairmat as recited in claim 11, wherein said sleeve is made of a second material distinguished from said material comprising said single sheet.

13. The chairmat as recited in claim 11, wherein said sleeve is an air pocket.

14. The chairmat as recited in claim 1, wherein said sheet covers a surface area for multiple occupied chairs.

15. The chairmat as recited in claim 1 further including at least one device for detecting temperature.

16. The chairmat as recited in claim 15, wherein said device for detecting temperature is exposed to the environment external to said sheet.

17. The chairmat as recited in claim 16, wherein said device for detecting temperature is connected to a controller, said controller adjustable by a user for setting a desired temperature.

18. The chairmat as recited in claim 1, further including an environmental detection device.

19. The chairmat as recited in claim 18, wherein said environmental detection device is configured such that it shares at least one electrical component with said at least one heating element.

20. The chairmat as recited in claim 1, further including a temperature control device, wherein said temperature control device includes a thermostat and is adjustable by a user.

21. The chairmat as recited in claim 1, wherein said heating element includes nichrome wire.

22. The chairmat as recited in claim 1, wherein said sheet includes at least one section that is thicker than another part of said sheet.

23. The chairmat as recited in claim 22, wherein said at least one heating element is included in at least a portion of said at least one thicker section.

24. The chairmat as recited in claim 22, wherein said at least one thicker section is located near an edge of said sheet.

25. The chairmat as recited in claim 1, further comprising anti-static means.

26. The chairmat as recited in claim 1, further comprising an anti-static conductive layer and an anti-static electrical connection.

27. A device for improving individual temperature control in a commercial or industrial setting including: a mat made of a single sheet of flexible hard material, said material chosen from the group consisting of vinyl, polyethylene, or combinations thereof, said flexible hard material capable of supporting movement along the surface of said mat of an office chair with casters and a user of up to 150 kg;

an electrical system, including at least one heating element, and at least one power source, a ground fault circuit interrupter and a power source, including a power conversion device; a control system, including a thermostat and an emergency shut off device connected to at least one sensor and connected to said electrical system;

wherein said heating element is enclosed inside said flexible hard material and said material is sufficiently protected from said at least one heating element that it retains its ability to be supportive;

wherein said single sheet includes at least one section that is thicker than another part of said sheet, and said at least one heating element is included in at least a portion of said at least one thicker section; and wherein said at least one thicker section is located near an edge of said sheet.

28. The device as recited in claim 27, where said heating element includes nichrome wire.

29. The device as recited in claim 27, wherein said sensor is located inside said flexible hard material and placed nears said heating element.

30. The device as recited in claim 1, wherein said sensor determines if an individual has been present for a specified period of time and shuts off the heating element.

31. The chairmat as recited in claim 30, wherein said presence sensor, includes a connection to a computing device.

32. A heating device comprising:

a single layer of a single plastic material, wherein said plastic is selected from the group consisting of vinyl, polyethylene, or combinations thereof;

at least one heating element completely enclosed within said single layer, such that at least one heating element is not exposed outside of said single layer;

a connection connected with said at least one heating element, wherein said connection is exposed outside of said single material;

a power source;

a ground; and a power control device electrically connected to said exposed connection;

further comprising an anti-slip mechanism on the bottom of said layer and part of said single layer, said anti-slip mechanism comprising proiections wherein said single layer includes at least one section that is thicker than another part of said layer, and said at least one heating element is included in at least a portion of said at least one thicker section, wherein said at least one thicker section is located near an edae of said layer.

33. The heating device recited in claim 32, wherein said anti-slip mechanism on the bottom of said sheet and part of said single sheet, said anti-slip mechanism comprising projections.

34. The device as recited in claim 27, wherein said anti-slip mechanism on the bottom of said sheet and part of said single sheet, said anti-slip mechanism comprising projections.

* * * * *